US005346449A

United States Patent [19]

Schlagel

[11] Patent Number: 5,346,449

[45] Date of Patent: Sep. 13, 1994

[54] BARBELL SYSTEM WITH IMPROVED LOCKING FEATURE

[76] Inventor: Bruce E. Schlagel, 5340 E. Vale Dr., Denver, Colo. 80222

[21] Appl. No.: 71,681

[22] Filed: Jun. 3, 1993

[51] Int. Cl.[5] ..... A63B 21/075

[52] U.S. Cl. ..... 482/107

[58] Field of Search ..... 482/104, 106–108; 403/261, 260, 286, 348

[56] References Cited

U.S. PATENT DOCUMENTS

| | | | |
|---|---|---|---|
| 1,672,944 | 6/1928 | Jowett | 482/108 |
| 1,991,520 | 2/1935 | Postl | 482/108 |
| 2,640,696 | 6/1953 | Lemieux | 482/107 |
| 4,569,105 | 2/1986 | Weider | 482/107 |
| 4,579,337 | 4/1986 | Uyeda | 482/107 |
| 4,638,994 | 1/1987 | Gogarty | 482/108 X |
| 4,893,810 | 1/1990 | Lee | 482/107 |
| 4,948,123 | 8/1990 | Schook | 482/107 |
| 5,024,434 | 6/1991 | Smith | 482/106 X |
| 5,163,887 | 11/1992 | Hatch | 482/106 X |

FOREIGN PATENT DOCUMENTS

| | | | |
|---|---|---|---|
| 238831 | 8/1925 | United Kingdom | 482/107 |

*Primary Examiner*—Robert Bahr

*Attorney, Agent, or Firm*—Robert G. Crouch

[57] ABSTRACT

A barbell system is provided with a pair of plunger pieces each having a shaft and an end plate and an elongated, cylindrical, hollow handle with a releasable coupling located on either end thereof to releasable grip the shaft of each of the plunger pieces after they are inserted into the handle so as to retain at least one weight between the handle and the end plate of each plunger piece.

9 Claims, 2 Drawing Sheets

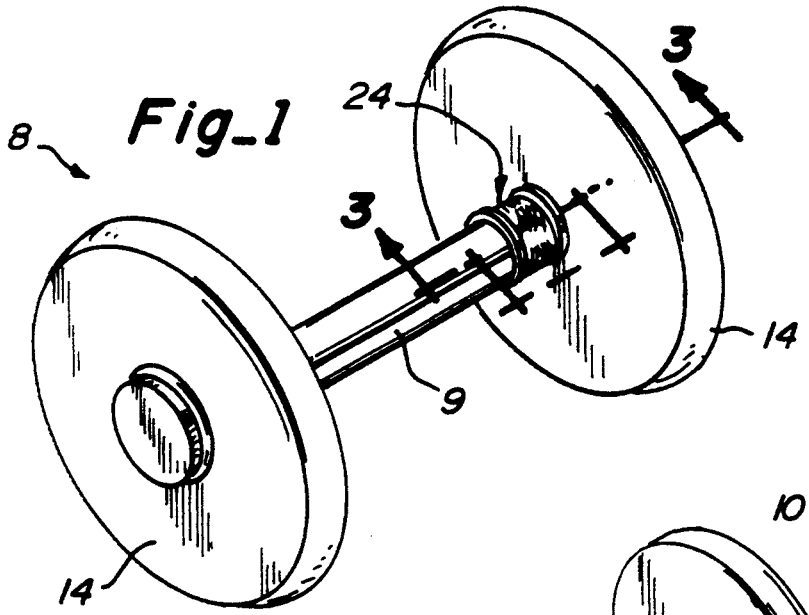
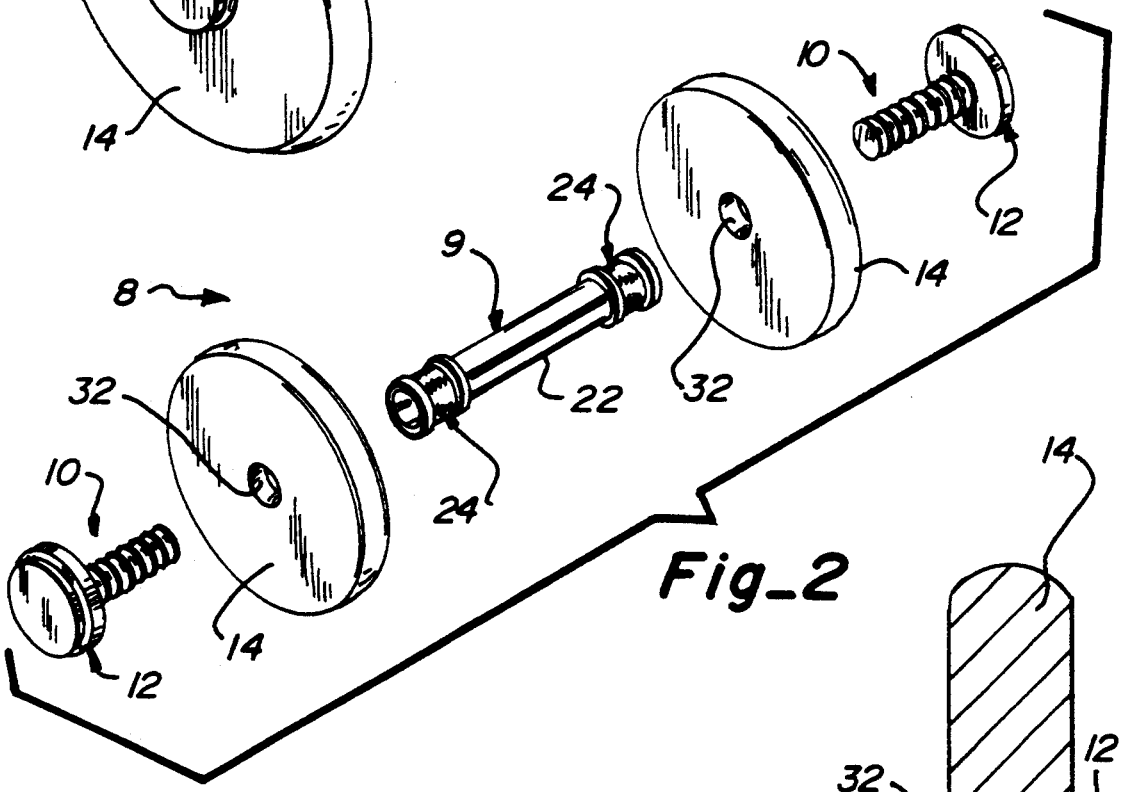
Fig_2
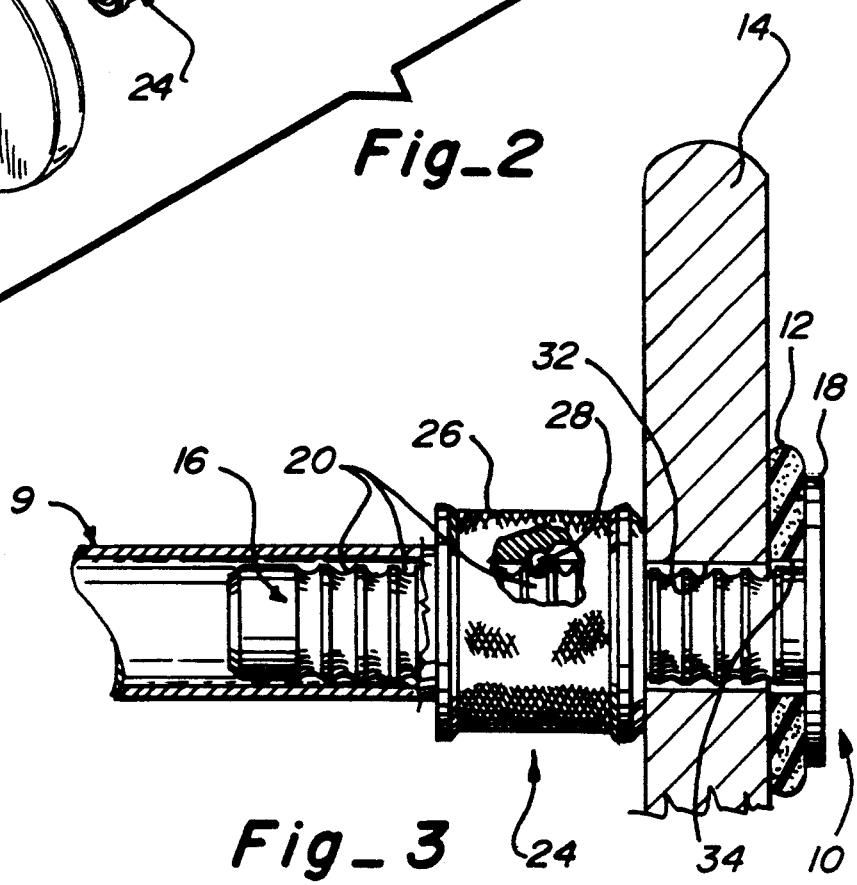
Fig_3

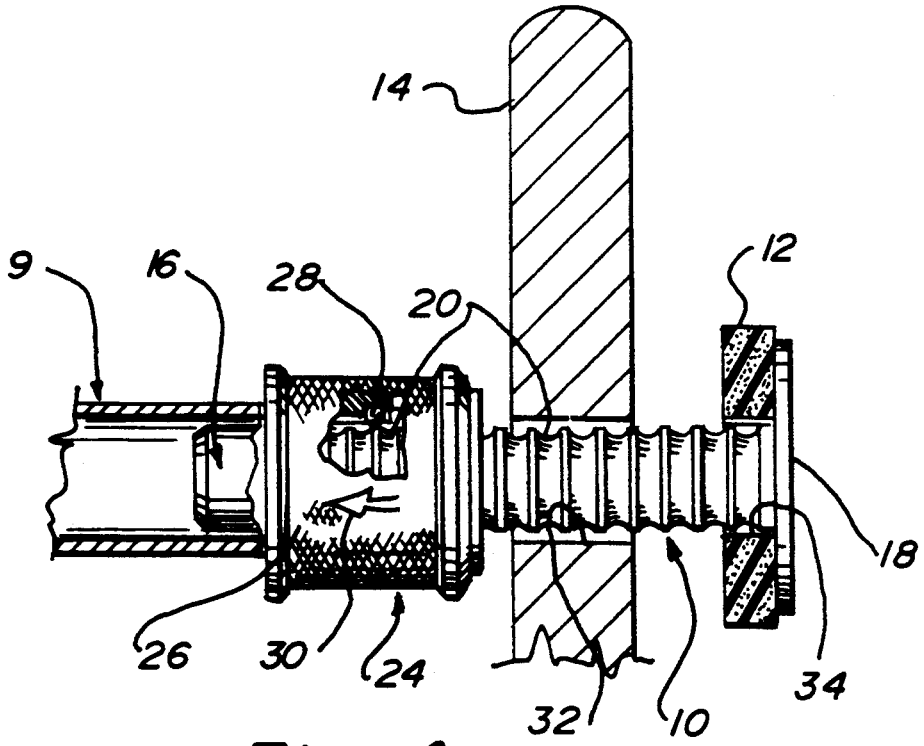
Fig_4
Fig_5
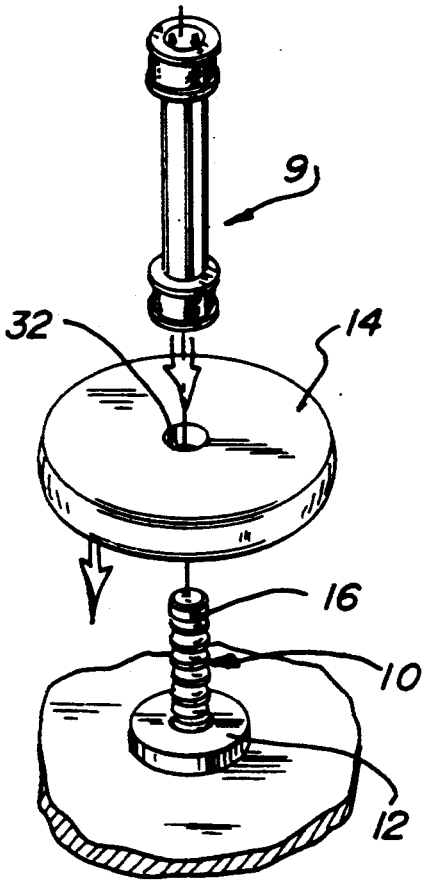
Fig_6
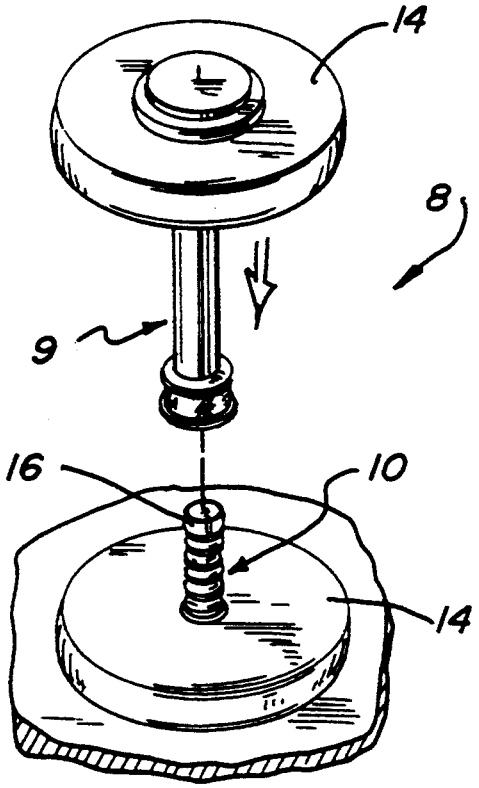

BARBELL SYSTEM WITH IMPROVED LOCKING FEATURE

BACKGROUND OF THE INVENTION

1. Field of the Invention

The present invention relates to barbells for use in weight-lifting, and, more particularly, to a new and improved method and apparatus for locking weights onto a supporting bar.

2. Discussion of the Prior Art

Barbell systems commonly include an elongated, cylindrical bar or handle onto which matching disc-shaped weights are placed at either end and releasably or permanently attached to the bar. There are elongated barbells which are designed for two-handed lifting and considerably shorter barbells which are designed for one-handed lifting, also known as dumbbells. In this application, the term barbell shall be used broadly to refer to both the one- and two-handed devices.

While solid, one-piece barbells are the most convenient, they are very expensive because, in order to have a variety of weights, it is necessary to have a large number of separate barbells. For this reason, barbell systems which allow a variety of separate weights to be attached to a single bar are very popular.

A variety of methods and apparatuses have been employed to releasably or removably attach weights to the handles of barbells. A typical apparatus includes an elongated, cylindrical bar, a hollow cylindrical handle placed over the bar and a pair of ring-shaped retaining members placed over the bar. A weight is slidably placed on each end of the bar between the handle and a retaining member. The retaining members each have a single bolt extending radially therethrough. The bolt has suitable surfaces on the head thereof to enable the user to hand turn the bolt. As the bolt is screwed or turned into the retaining member, the tip of the bolt extends inwardly from an inner surface of the ring-shaped retaining member and comes into contact with the bar. As the bolt is further tightened, the retaining member is held securely against the bar. The weight is thus held securely on the bar between the immediately adjacent handle and retaining member.

A second common system includes an elongated bar with a central handle portion and with an externally-threaded portion at either end of the bar. The handle portion has a greater diameter than the threaded portion. Loose weights are placed onto either end of the bar and large nuts with internal threading are screwed onto the bar to retain the weights between the nuts and the handle portion of the bar.

A third system for attaching disc-shaped weights to a barbell is disclosed in U.S. Pat. No. 1,672,944. This system includes a hollow, internally-threaded bar and a pair of screws with enlarged heads which may be inserted through the holes in the disc-shaped weights and screwed into the bar to secure the weights to the bar.

Another system, disclosed in U.S. Pat. No. 4,579,337, includes a bar with a series of circumferential grooves on each end thereof and a fixed, raised protuberance or lip on the bar adjacent to each of the innermost grooves. This system also includes a pair of locking members to be placed on the bar, with each member containing a pair of cylindrical members which are believed to be rotated relative to each other to allow or restrict steel balls to move freely within the locking member or to be restrained to be in engagement with one of the aforementioned grooves. As can be appreciated, this barbell system includes a fixed length bar which is much longer than necessary in addition to requiring a slow and cumbersome method of attaching the locking members to the bar.

Another system for affixing weights to a barbell is disclosed in U.S. Pat. No. 4,638,994. This technique includes a hollow, internally-threaded bar and a pair of locking pins having a head which engages with a flat locking collar designed to hold a ring-shaped weight against the hollow bar. The locking pin also includes a shaft having a spring-biased tooth which is yieldingly urged radially outwardly from the shaft to engage with the threads of the hollow handle. Thus, the pin can be quickly inserted into the hollow handle but must be screwed out of the handle to remove the pin.

It is believed that none of the prior art systems include the ability to quickly and securely connect weights to the bar and quickly disconnect weights from the bar nor do these systems have these features with the added convenience of a barbell system which does not extend longitudinally outside of the weights. It is against this background and to overcome the shortcomings of the prior art that the present invention has resulted.

SUMMARY OF THE INVENTION

The barbell system of the present invention includes a unique arrangement for releasably locking weights onto a supporting bar. The barbell system includes a pair of plunger pieces, each having a shaft and an end plate, and an elongated handle with a means thereon for releasably gripping the shaft of each plunger piece to retain the weights between the handle and the end plates of the plunger pieces.

The method for assembling a barbell in accordance with the teachings of the present invention includes the steps of providing a pair of plunger pieces, each having a shaft and an end plate, and an elongated handle including locking collars at each end, placing at least one ring-shaped weight on each of the first and second plunger pieces, placing the elongated handle onto the shaft of the first plunger piece and allowing the locking collar to releasably grip the first plunger piece, and placing the second end of the elongated handle onto the second plunger piece and allowing the locking collar to releasably grip the second plunger piece.

Other aspects, features and details of the present invention can be more completely understood by reference to the following detailed description of the preferred embodiment, taken in conjunction with the drawings, and from the appended claims.

DETAILED DESCRIPTION OF THE DRAWINGS

FIG. 1 is an isometric view of the barbell system of the present invention.

FIG. 2 is an exploded isometric view of the barbell system shown in FIG. 1.

FIG. 3 is a section taken along line 3—3 of FIG. 1 showing the locking collar gripping the plunger piece with the plunger piece shown in full view and a portion of the locking collar broken away to schematically show one of the retaining balls engaging with the plunger piece.

FIG. 4 is a section taken along line 3—3 of FIG. 1 showing the locking collar in a position where the plunger piece can be removed therefrom with the plunger piece shown in full view and a portion of the locking collar broken away to schematically show one of the retaining balls free-floating so as not to engage with the plunger piece.

FIG. 5 is an isometric view of components of the barbell system of the present invention showing the assembly of same.

FIG. 6 is an isometric view of components of the barbell system of the present invention showing further assembly of same.

DESCRIPTION OF THE PREFERRED EMBODIMENT

The barbell system e of the present invention is shown in FIGS. 1 and 2. It can be seen in FIG. 2 that the system includes an elongated, cylindrical, hollow handle 9, a pair of plunger pieces 10 for attachment to the handle at opposite ends thereof, a pair of compressible spacers 12 for placement between the handle and the plunger pieces and two or more loose weights 14. The plunger pieces are inserted through the radial center of the loose weights before inserting the plunger pieces into opposite open ends of the handle so as to retain the weights between a portion of the plunger pieces and the handle.

The plunger pieces 10 each include an elongated, substantially cylindrical shaft 16 and an integral, enlarged, circular end plate 18 located at one end thereof, as best seen in FIG. 2. The shaft has a series of axially spaced, circumferential, circular grooves 20 in its external surface. The end plate has a substantially greater diameter than the elongated shaft.

The handle 9 includes an elongated, hollow, cylindrical main body 22 with a gripping area in the central portion thereof and releasable couplings 24 located at each end, as shown in FIG. 2. The releasable couplings are conventional and of the type typically used as hydraulic hose couplings. The couplings are shown in schematic detail in FIGS. 3 and 4. A releasable coupling found to be suitable for use in the barbell system 8 of the present invention can be obtained from Aeroquip Corporation of Maumee, Ohio under part number 3000-T Strayer.

The releasable couplings 24 are identical and include a hollow cylindrical locking collar 26, a confined, helical compression spring (not shown) and four equally-spaced retaining balls 28. The compression spring biases the collar toward a position wherein the retaining balls are extended radially inwardly from the inner surface of the hollow handle 9, as schematically shown in FIG. 3. When the locking collar is moved axially in the direction of the arrow 30 in FIG. 4, the retaining balls are free-floating, so that they may be forced radially outwardly toward the locking collar so as not to extend into the hollow handle. Thus, it can be appreciated that, with the locking collar in its normally-biased position, the balls are seated in one of the circular grooves 20 on the plunger piece 10 so as to lock the plunger piece in the handle. Conversely, when the locking collar is moved in the direction of the arrow 30 in FIG. 4, the balls are released from their seated position and the plunger piece may be further inserted into or removed from the hollow handle.

The weights 14 used with the barbell system 8 of the present invention are of a conventional type being disc-shaped, solid pieces of predetermined weight. At the radial center of each weight an opening 32 is formed allowing the weight to be placed over the shaft 16 of the plunger piece The compressible spacer 12 of the present invention, shown in FIGS. 1–3, is also ring- or disc-shaped. Preferably it is manufactured from a dense foam or neoprene material. In a similar fashion to the weights 14, the spacer has an opening 34 defined at the radial center thereof to allow it to be placed over the shaft 16 of the plunger piece 10. Preferably, the spacer is located between the end plate 18 of the plunger piece and the weight or weights which are also placed onto the plunger piece. The function of the spacer is to allow a snug fit of the weights within the barbell system e while allowing the retaining balls 28 of the releasable coupling 24 to fit into one of the discretely located circumferential grooves 20 of the plunger piece. In other words, without the spacer, if the width of the weight or weights was such as to not allow a snug fit of the weights between the end plate and the releasable coupling, no adjustment could be made due to the fixed discrete locations of the grooves. However, with the compressible spacer, it can simply be compressed so that the releasable coupling can grip the next adjacent groove assuring a snug fit.

The present invention allows convenient assembly of the system 8 as seen in FIGS. 4 and 5. First, a pair of plunger pieces 10 are provided with their shafts exposed. The compressible spacers 12 are placed onto each of the shafts, followed by the desired number of weights 14 on each shaft. Next, the elongated handle 9 is placed onto the shaft of one of the plunger pieces with the locking collar 26 in the retracted position to allow the releasable coupling 24 to slide over the grooves 20 of the plunger piece. The coupling is then released, allowing the retaining balls 28 to engage with the grooves of the plunger piece. The partially assembled system is then placed onto the shaft of the remaining plunger piece in a similar fashion.

A presently preferred embodiment of the present invention has been described above with a degree of specificity. It should be understood, however, that this degree of specificity is directed toward the preferred embodiment. The invention itself, however, is defined by the scope of the appended claims.

The invention claimed is:

1. A barbell system onto which weights can be releasably locked, comprising:

a pair of plunger pieces each having an elongated shaft and an end plate; and an elongated handle including means located thereon for releasably gripping the shaft of each plunger piece so as to retain a weight between the handle and the end plate of each plunger piece and for releasing said shaft to allow the shaft and weight to be removed, wherein said releasably gripping means comprises:

a locking sleeve;

a plurality of balls retained within the locking sleeve; and a biasing means retained between the locking sleeve and the elongated handle for biasing the locking sleeve from a released position into a gripping position, wherein in said gripping position the plurality of balls are urged toward the elongated shaft of the plunger piece to retain the plunger piece in position within the handle;

whereby the locking sleeve can be selectively slid toward the released position to release the grip of the plurality of balls on the elongated shaft of the plunger pieces and upon release of the locking sleeve the biasing means will slide the locking sleeve toward the gripping position to grip and retain the elongated shaft in position within the handle.

2. A barbell system as defined in claim 1 which further includes a compressible spacer disposed between the weight and the end plate of each plunger piece.

3. A barbell system as defined in claim 2 wherein the compressible spacer is composed of a dense foam.

4. A barbell system as defined in claim 3 wherein said compressible spacer can be compressed sufficiently to allow the plurality of balls retained within the releasable coupling to engage with one of said circumferential grooves on said shaft of one of said plunger pieces and decompressed to allow the plurality of balls to engage with the next adjacent of said circumferential grooves.

5. A barbell system as defined in claim 1 wherein each of the plunger pieces has a series of separated circumferential annular groves located on the external surface of the shaft.

6. A barbell system as defined in claim 1 wherein the biasing means includes a helical spring.

7. A barbell system as defined in claim 1 wherein the elongated handle is hollow, allowing the shaft of the plunger piece to be inserted therein.

8. A barbell system as defined in claim wherein said end plate includes a surface adapted to lie on a horizontal surface in a position so that the elongated shaft extends in an upward direction which is substantially perpendicular to the horizontal surface to allow for the two-handed placement of said weights onto each plunger piece.

9. A barbell system onto which weights can be releasably locked, comprising:

a pair of elongated plunger pieces each having a radially-extending disc-shaped end plate and an elongated shaft with a series of separated circumferential annular grooves wherein the end plate is adapted to lie on a horizontal surface in a position so that the elongated shaft extends in an upward direction which is substantially perpendicular to the horizontal surface;

a compressible spacer located on the shaft of each plunger piece and retained between the weight and the end plate of each plunger piece, the spacer made up of a dense foam material; and an elongated hollow handle including a releasable coupling for releasably gripping the shaft of each plunger piece so as to retain a weight between the handle and the compressible spacer on the elongated shaft and for releasing said shaft to allow the shaft and weight to be removed, the coupling comprising:

a locking collar;

a plurality of balls retained within the locking collar; and a helical spring retained between the locking collar and the elongated handle for biasing the locking collar from a released position into a gripping position, wherein in said gripping position the plurality of balls are urged toward the elongated shaft of the plunger piece to retain the plunger piece in position within the handle;

whereby the locking collar can be selectively slid toward the released position to release the grip of the plurality of balls on the elongated shaft of the plunger pieces and upon release of the locking sleeve the biasing means will slide the locking sleeve toward the gripping position to grip and retain the elongated shaft in position within the handle;

wherein said spacer can be compressed sufficiently to allow the plurality of balls retained within the releasable coupling to engage with one of said circumferential grooves on said shaft of one of said plunger pieces and decompressed to allow the plurality of balls to engage with the next adjacent of said circumferential grooves.

* * * * *